United States Patent [19]

Janson

[11] 4,285,095

[45] Aug. 25, 1981

[54] CHANNEL STRUT FOR STAGE EQUIPMENT SUPPORT SYSTEM

[76] Inventor: Richard W. Janson, Box 6090, Canton, Ohio 44706

[21] Appl. No.: 71,586

[22] Filed: Aug. 31, 1979

Related U.S. Application Data

[60] Continuation-in-part of Ser. No. 855;256, Nov. 28, 1977, Pat. No. 4,166,306, which is a continuation of Ser. No. 734,106, Oct. 20, 1976, which is a division of Ser. No. 617,508, Sep. 29, 1975, Pat. No. 4,014,071.

[51] Int. Cl.[3] ..... A47M 15/00

[52] U.S. Cl. ..... 16/94 R; 16/96 R; 52/729

[58] Field of Search ..... 16/96 R, 94 R, 94 D, 16/95 R, 95 D, 96 D, 160, 123, 248, 261, 262; 403/331, 305; 52/729

[56] References Cited

U.S. PATENT DOCUMENTS

| | | | |
|---|---|---|---|
| 2,307,653 | 1/1943 | Wright | 52/729 |
| 3,004,636 | 10/1961 | Shane | 16/96 R X |
| 3,148,752 | 9/1964 | Lesage | 52/729 |
| 3,566,561 | 3/1971 | Tozer | 52/729 |
| 3,712,015 | 1/1973 | Nelson | 52/729 |
| 4,014,071 | 3/1977 | Janson | 16/96 R |
| 4,019,298 | 4/1977 | Johnson | 403/331 X |
| 4,034,957 | 7/1977 | Cody | 52/729 |
| 4,070,845 | 1/1978 | Cody | 52/729 |
| 4,102,007 | 7/1978 | Janson | 16/94 R |
| 4,102,008 | 7/1978 | Janson | 16/96 R |
| 4,103,393 | 8/1978 | Janson | 16/94 R |
| 4,133,155 | 1/1979 | Oelrich | 52/729 |
| 4,159,604 | 7/1979 | Burpell | 52/729 |
| 4,166,306 | 9/1979 | Janson . | |
| 4,182,532 | 1/1980 | Walker | 16/94 R |

*Primary Examiner*—Ronald Feldbaum
*Attorney, Agent, or Firm*—Mason, Mason and Albright

[57] ABSTRACT

A supporting grid system for installation under a stage ceiling which includes a plurality of struts suspended from the stage ceiling. Each strut has a centrally vertically disposed I-beam portion and a pair of spaced-apart upper arms extending upwardly and outwardly from the upper aspect of the central portion and a further pair of spaced-apart lower arms extending downwardly and outwardly from the central portion. Both pairs of arms define cruciform-shaped grooves, such grooves being identical but opposed. The strut is integral and formed from extruded aluminum. It is normally secured in place by hanger rods connected to the ceiling of the stage through support members having a horizontal flange and a support part of cruciform-shaped cross-section to mate with and be received slideably within the cruciform-shaped groove defined at the top of the strut. Similar support members are received in the bottom groove of the strut and are interconnected by further like support members to a curtain rod assembly wherein the curtain rod defines an elongated cruciform groove in its upper portion to receive cruciform-shaped part on the further support member. The struts extend fore and aft relative to the stage whereby the curtain rods extend transversely. Horizontal flanges are provided on each curtain rod's lower portion to receive wheeled curtain carriers. Both the rod and the strut are symmetrical about a vertical axis and the strut is also symmetrical about a horizontal axis. The curtain rod is adapted to receive chain links in its cruciform slot for supporting the rod either as a safety measure or for supplementary support.

10 Claims, 26 Drawing Figures

FIG. 1
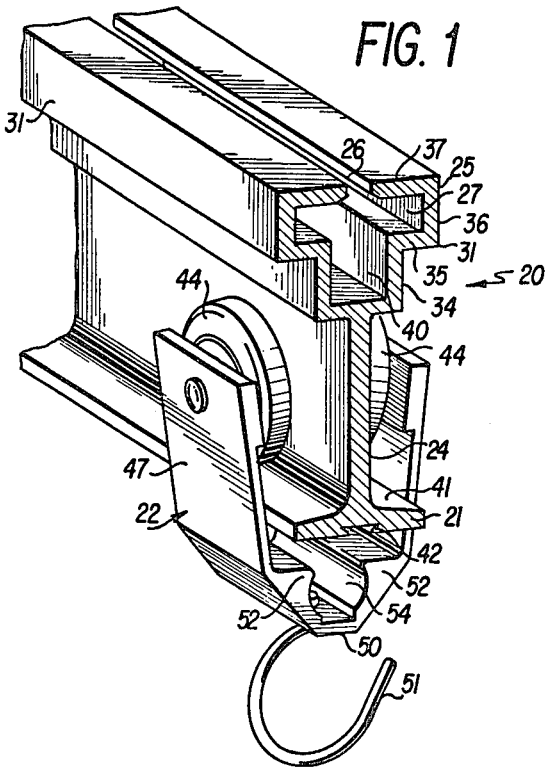
FIG. 1A
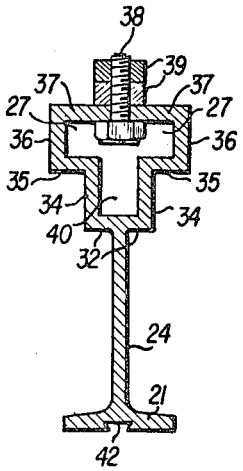
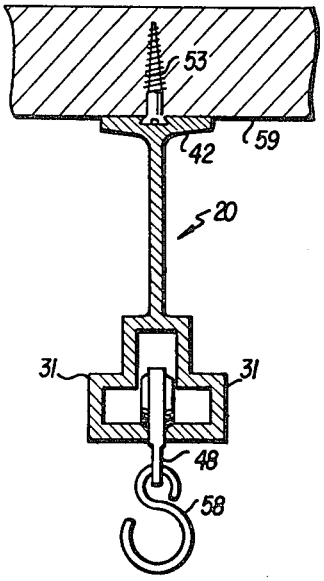
FIG. 1B
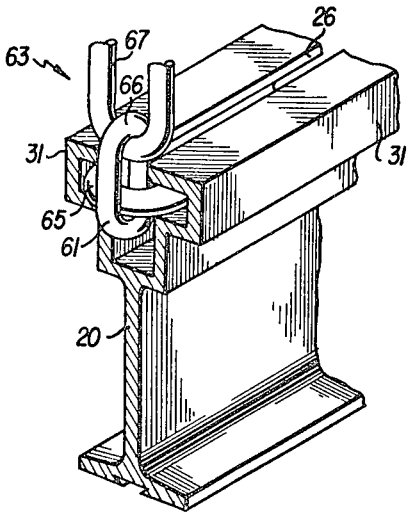
FIG. 2

CHANNEL STRUT FOR STAGE EQUIPMENT SUPPORT SYSTEM

RELATED APPLICATIONS

This is a continuation-in-part application of application Ser. No. 855,256, filed Nov. 28, 1977, issued as U.S. Pat. No. 4,166,306, Sept. 4, 1979, which is a continuation of application Ser. No. 734,106, filed Oct. 20, 1976, which is a divisional application of application Ser. No. 617,508 filed Sept. 29, 1975, issuing Mar. 29, 1977, as U.S. Pat. No. 4,014,071.

BACKGROUND OF THE INVENTION

Various types of channel strut support systems for curtain suspension devices are available commercially and known in the prior art. Examples of types of curtain suspension devices may be found in the U.S. Pat. Nos. to Hankin, 3,346,227 of Oct. 10, 1967, to Charron et al, 2,597,224, of May 20, 1972 and Des. 165,937 to Rosenbaum of Feb. 12, 1952. An increasing problem exists in the installation of stage equipment and curtain suspension assemblies—particularly the larger heavy-duty assemblages—in the labor costs of installing same. Thus, as the systems become more complicated, time required for installation and the level of skill required increases. It has occurred to the inventor that this problem may be solved through designing suspension systems at the plant as relatively simplified units which can be installed without the necessity of complicated or involved construction procedures and which at the same time are adaptable to a wide variety of architectural arrangements which may be encountered particularly in commercial and public establishments.

SUMMARY OF THE INVENTION

The invention relates to a supporting strut curtain suspension assembly and to its components in various combinations. More particularly, the invention relates to such a strut and components combined therewith intended for heavy-duty use such as for supporting curtain suspension assemblies in theaters and the like wherein the design and cooperation of the components of the system facilitate its installation and the system is thus easily installed and also adaptable to numerous overhead constructions which may be encountered.

Various components which may be used in combination with the invention include a curtain rod which has flanges in its lower portion to receive curtain rod carriers and defines a cruciform-shaped groove of constant cross-section in its upper portion to receive a mating like shaped part of an overhead support or other component which, in turn, is connected with the strut of the invention. The cruciform-shaped groove may cooperate with an appropriately dimensioned link chain whereby the rod can be connected to overhead structure either to provide supplemental support or for safety purposes. Various supports which include the cruciform-shaped part for being received in the groove are adapted to cooperate with angle clips, gripping devices, bolts of various types and the like to provide considerable adaptability and flexibility in supporting and securing the curtain rod to the overhead strut structure at the installation site. Spacer dividers are included which automatically establish the amount of overlap at the mid-portion of the curtain rods, provide a midway stop for the curtain rod carriers and further include a centrally located support for the rope which controls the curtains for opening and closing same. Live-end and deadend pulley housings with pulleys installed are further provided which may either be suspended from the cruciform-shaped groove of the curtain rod or from the lower flange thereof and secured so as not to be movable longitudinally relative to the curtain rod whereby they are automatically located in a desired position relative to the rest of the assemblage. A novel adaptability of the curtain rod is its capacity to be inverted and used as a curtain rod for lesser sized installations wherein carriers for the curtain are received within the cruciform-shaped groove with their curtain hooks depending therefrom.

From the foregoing, it will be understood by those skilled in the art that an important and primary object of the instant invention is the provision for a heavy duty adaptable and yet simplified supporting strut system for stage equipment and which is constituted of components which are preferably manufactured of extruded aluminum or other extruded material. However, other objects of adaptabilities and capabilities of the invention will be appreciated by those skilled in the art as the description progresses, reference being had to the accompanying drawings in which:

BRIEF DESCRIPTION OF THE DRAWINGS

FIG. 1 is a perspective view of a first embodiment of a component of the invention showing the curtain rod and a curtain carrier thereon;

FIG. 1A illustrates the incorporation of limiting means in the curtain rod;

FIG. 1B shows the curtain rod in an inverted mode;

FIG. 2 is a perspective view of the curtain rod shown in FIG. 1 with a link chain extending from its slot;

DESCRIPTION OF THE PREFERRED EMBODIMENTS

Figure 3:
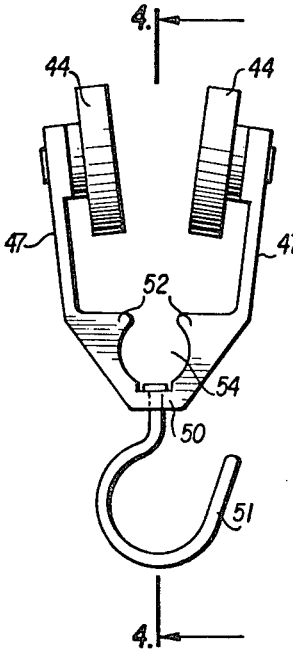
FIG. 3 is an elevational detail view of the carrier shown in FIG. 1.

Referring to FIG. 1, a curtain track or rod 20 is shown which supports on its lower flange 21 a plurality of curtain carriers such as carrier 22. Rod 20 comprises a vertical part 24 which extends upwardly normally from flange 21 to the upper portion 25 which defines a slot 26 in groove 27 for receiving a rod support 30 as shown, for example, in FIG. 5. Upper portion 25 comprises a pair of arms 31 which, as seen in cross-section are mirror images, one of the other, each including first a horizontal extension 32, next a second vertical extension 34, then a third further horizontal extension 35, and next a fourth further vertical extension 36, each arm 31 then extending inwardly to define slot 26, thus terminating with a fifth still further horizontal extension 37. Arms 31 define a cruciform-shaped space as seen in cross-section which comprises upper slot 26, grooves 27 on either side and a lower recess 40 between vertical part 24 and slot 26. In the lower portion 41 of rod 20, flange 21 may be provided with a bottom groove 42 which is broader in its upper inner aspect than at its lower aspect.

In FIG. 1A, a stop or limiting means is provided which comprises a bolt 38 which has its head within the grooves 27 and its threaded shank extends upwardly through slot 26 wherein it is threadably received by a pair of nuts 39.

As shown in FIG. 1B, by inverting rod 20, it may be utilized for a less expensive curtain track for a lighter curtain or drapes wherein the space defined by arms 31 receives a plurality of movable supporting members 48 which are each provided with a depending hanger portion 58, such supporting member 48 conforming to a structural device disclosed in U.S. Pat. No. 3,076,222 to P. H. Sloan of Feb. 5, 1973. The recess 42 is utilized to support rod 20 by a plurality of flat head screws 53 received and aligned in a ceiling member 59.

Figure 4:
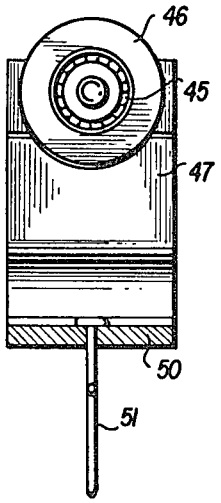
FIG. 4 is a sectional view of the carrier shown in FIG. 3 on section lines 3—3 of such Figure.
Figure 18:
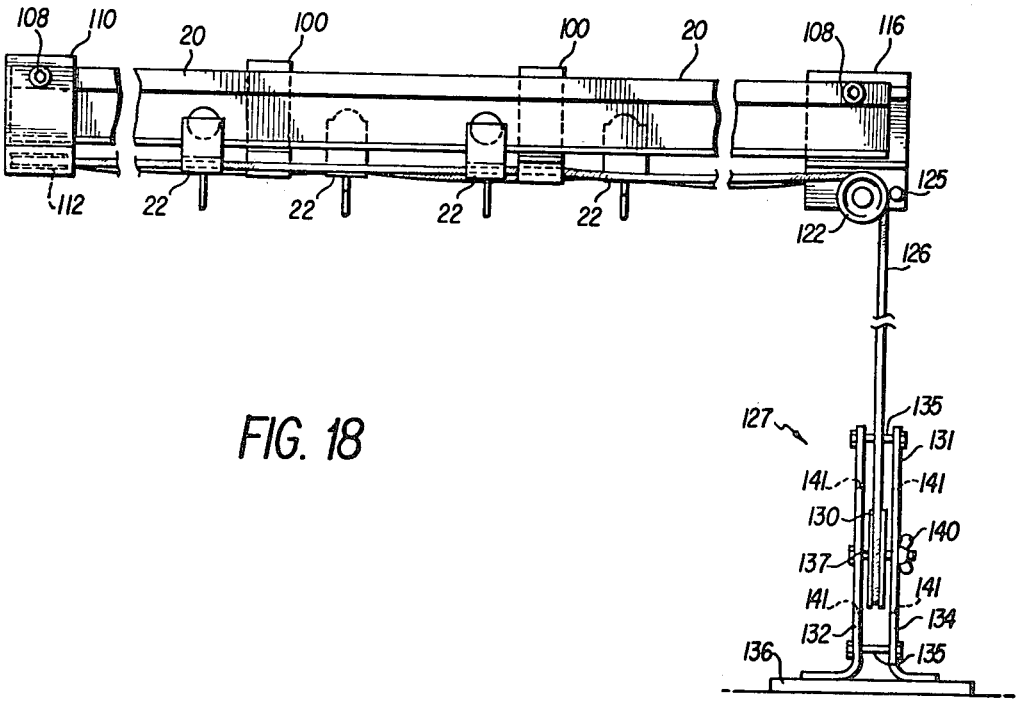
FIG. 18 is an elevational broken view which illustrates cooperation of various components of the curtain suspension assembly.
Figure 19:
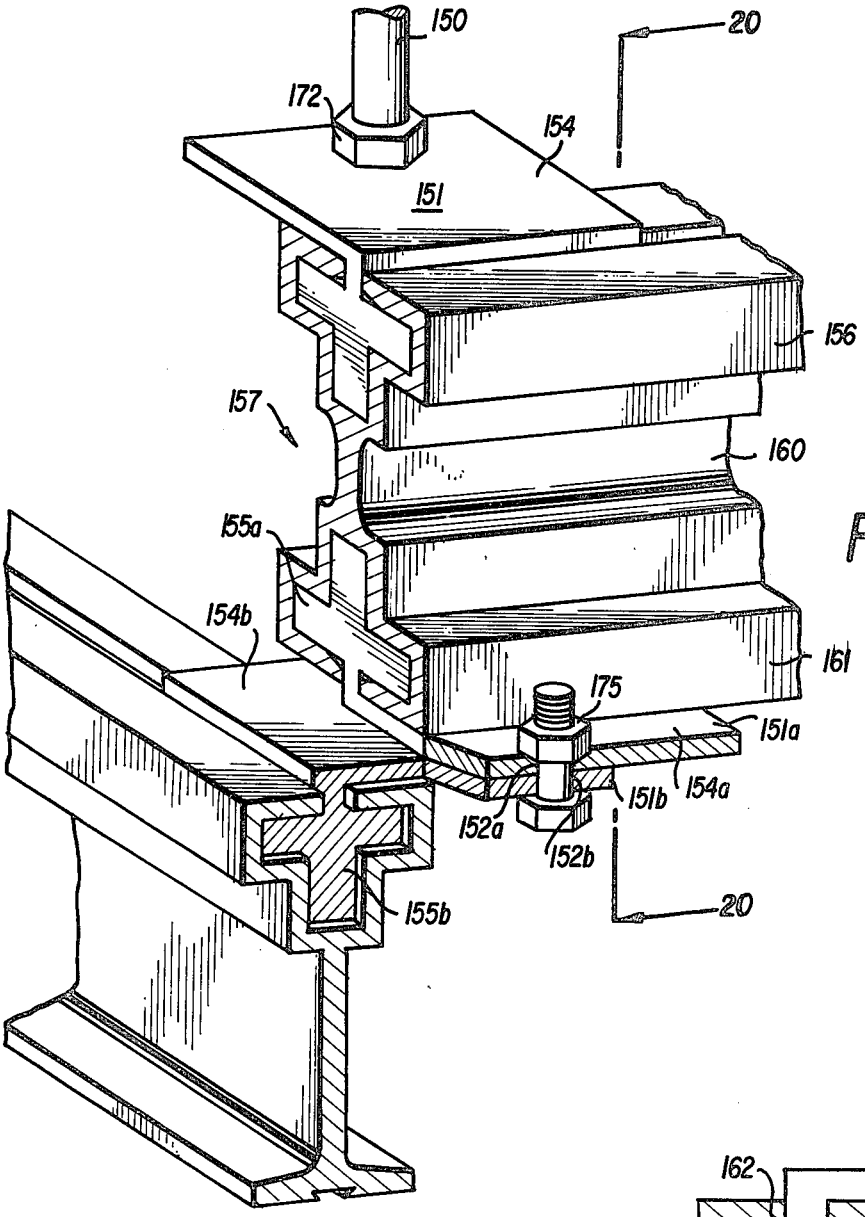
FIG. 19 is a perspective view of a strut in accordance with the invention which is suspended from a stage ceiling and which in turn suspends a curtain rod with curtain carriers thereon, the strut, support members and the curtain rod being shown in partial section.

Curtain carriers 22 as shown in FIGS. 1, 3 and 4 incorporate two wheels 44, each such wheel having a race of ballbearings 45 and equipped with rubber or neoprene tires 46 for silent operation. Each wheel 44 is journalled to an arm member 47. The lower part of each arm member 47 joins and is integral with a horizontal member 50 which carries a depending curtain hook 51. Each arm member 47 also includes a thicker profiled part 52 which defines a horizontal cylindrical opening 54 for frictionally receiving the curtain rope 126 (FIG. 18).

Figure 5:
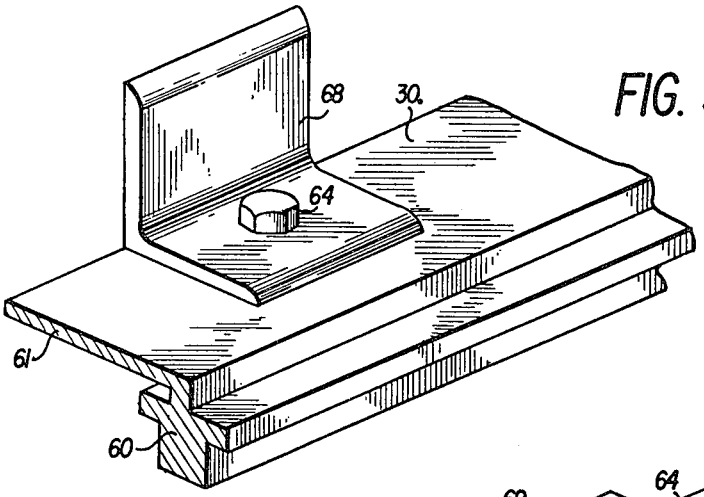
FIG. 5 is a perspective view of a rod support bolted to an angle clip.
Figure 6:
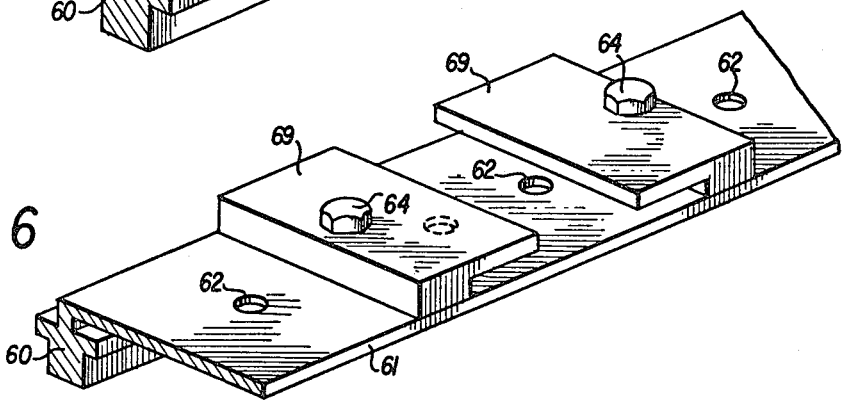
FIG. 6 is a perspective view of a rod support with cross-beam clamps bolted thereto.
Figure 8:
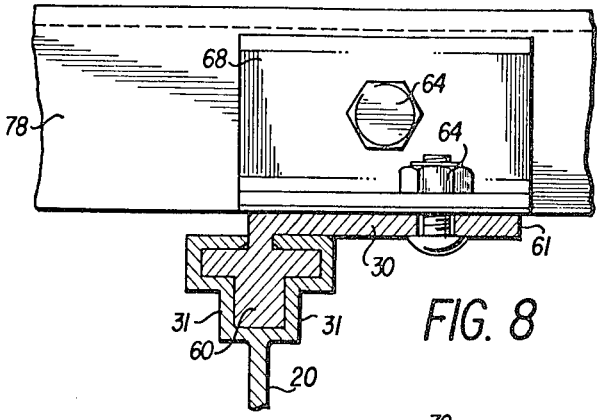
FIG. 8 is a broken view illustrating an angle clip similar to that shown in FIG. 5 together with the rod support and curtain rod.

Each rod support 30, as seen in FIGS. 5 and 8 includes a support part 60 of cruciform-shaped cross-section so as to mate with and be received slideably within the cruciform-shaped space defined by arms 31 of rod 20. Rod support 30 also comprises a horizontal flange member 61 extending in one direction from the top of part 60 and integral therewith. As illustrated in FIG. 6, flange member 61 may be provided with one or more openings 62 to receive bolts 64 or the like whereby support 30 may be connected to the lower flanges of I-beams of various sizes by cross-beam clamps 69 or via angle clip 68, to an overhead beam 78 as shown in FIG. 8.

Figure 7:
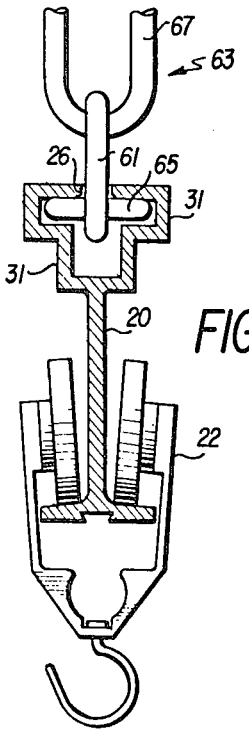
FIG. 7 is an elevational view showing a curtain rod supported by a link chain with a carrier.

With particular reference to FIGS. 2 and 7, a link chain 63 may be provided at any point along rod 20 and without the necessity of utilizing drills or other tools or bolts. This is accomplished by inserting the bottom or lower link 65 into the cruciform-shaped space defined by arms 31 with the next to last link 66 extending through the slot 26 in a vertical disposition. The next higher link 67 and other links also hang vertically. Accordingly, with an appropriate dimensioned link chain 63, rod 20 may, if desired, be supported by such link chain without the necessity of drilling holes or using nuts and bolts. Moreover, the link chain 63 may be slipped along the slot 26 until under an overhead beam or other structured member to which chain 63 may be attached to support, at least in part, the curtain rod 20 at the desired height. Alternatively, the link chain 63 may be used effectively and with minimal expense in conjunction with primary supporting components to provide secondary supporting structure should the primary support fail.

Figure 9:
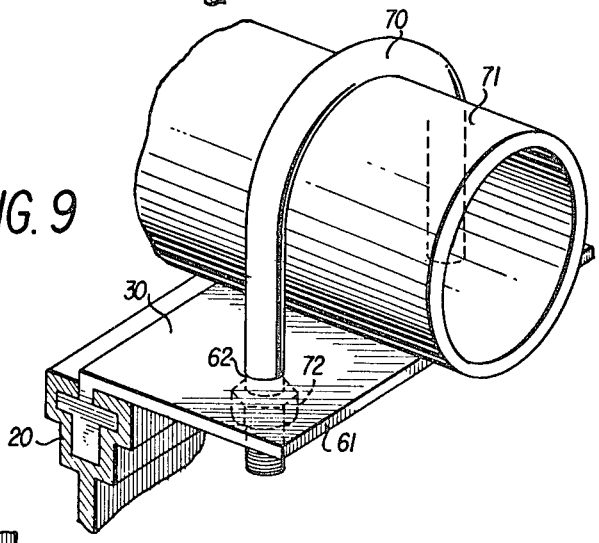
FIG. 9 is a perspective view illustrating a rod support as shown in FIG. 5 connected to an overhead pipe.

FIG. 9 illustrates a rod 20 supported by a rod support 30 which in turn has its flange member 61 connected to a pipe 71 by means of a U-bolt 70 received through a pair of openings 62 with lower threaded portions of U-bolt 70 receiving a pair of nuts 72 (only one being shown). The extrusion which constitutes support 30 and flange member 61 may be severed at an angle other than 90° relative to rod 20.

Figure 10:
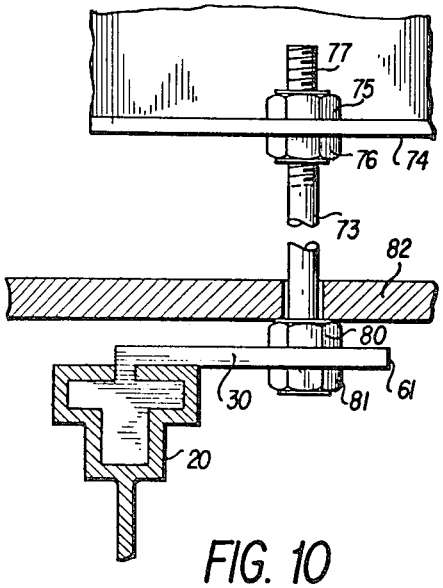
FIG. 10 is an elevational view illustrating means to suspend a rod support as shown in FIG. 5 under a suspended ceiling.

In FIG. 10, means for attaching the rod support 30 to a suspended ceiling 82 is disclosed. Here a bolt 73 is secured directly to an overhead bottom flange 74 of a steel roof member by nuts 75 and 76 received on the threaded end portion 77 of bolt 73. Flange member 61 receives the lower end of bolt 73 through an opening 62 and is secured thereto by means of nuts 80 and 81 in a manner whereby nut 80 performs the further function of contributing to the support of the suspended ceiling 82. Through this arrangement hangers or bolts 73 position rod support 30 immediately below the suspended ceiling 82.

Figure 11:
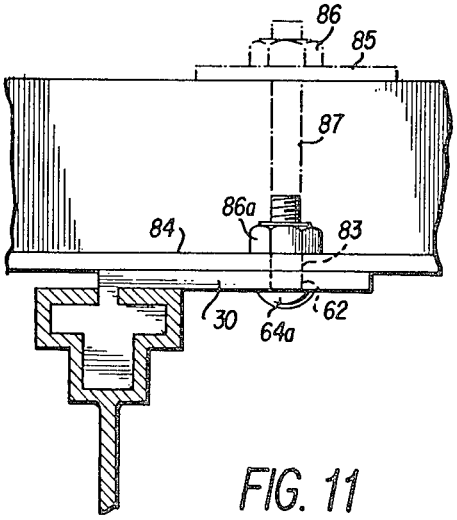
FIG. 11 is an elevational view illustrating connection of a rod support shown in FIG. 5 to the bottom chord of joists.

In FIG. 11, rod support 30 is fastened directly to the bottom of an exposed steel flange 84 or, if the bottom chord of the joist comprises angles situated back-to-back with a space between, longer fully threaded bolts 87, as indicated in dot-dash lines, are used with a heavy washer 85 to bridge such joists which are situated back-to-back, the heavy washer 85 held in place by means of a nut 86. In fastening rod support 30 directly to the bottom of steel flange 84, a short threaded bolt 64*a* is employed through the opening 62 and a further opening 83 in flange 84. A nut 86*a* is received by bolt 87 which is tightened against flange 84 as shown in FIG. 11.

Figure 12:
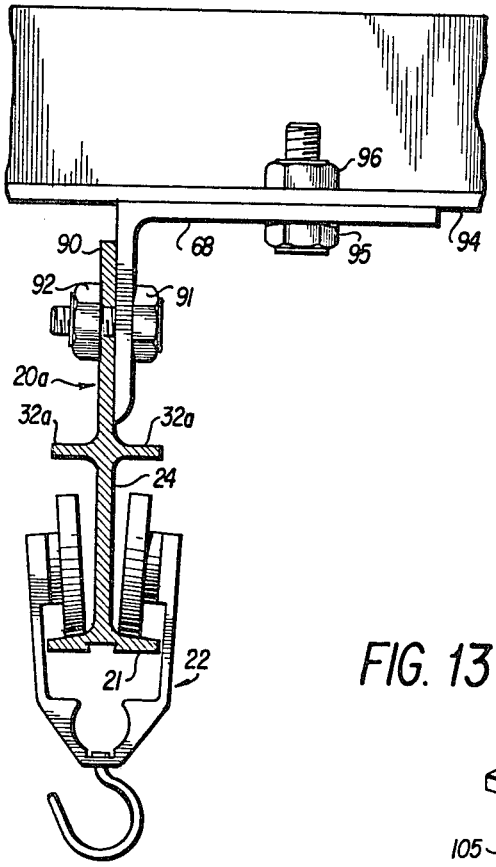
FIG. 12 is an elevational view of a modified curtain rod with a carrier thereon which is connected directly by means of an angle clip to the bottom chord of an overhead joist.

In FIG. 12 a modified rod 20*a* is shown which is similar to rod 20 in that it includes a vertical part 24 and a lower flange 21 which supports curtain carriers 22. It also includes a pair of oppositely extending horizontal extensions 32*a*, but instead of having arms 31, a single vertical plate part 90 is provided which is bolted to an angle clip 68 and by means of bolt 91 and nut 92 as shown in FIG. 12. Angle clip 68, in turn, is bolted to the bottom flange of an overhead I-beam by means of bolt 95 and nut 96.

Figure 13:
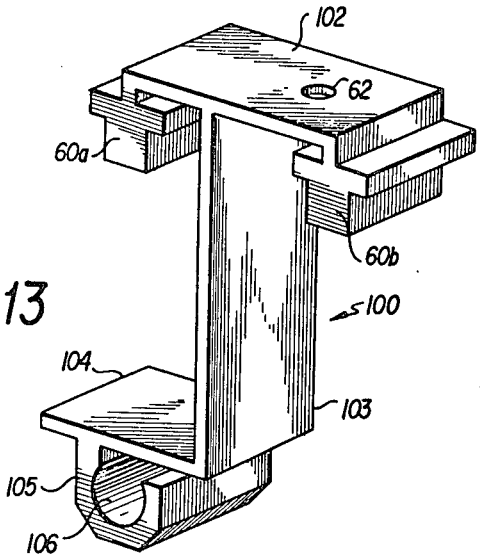
FIG. 13 is a perspective view of a combination lapping spacer, rod support, carrier bumper and rope holder.
Figure 14:
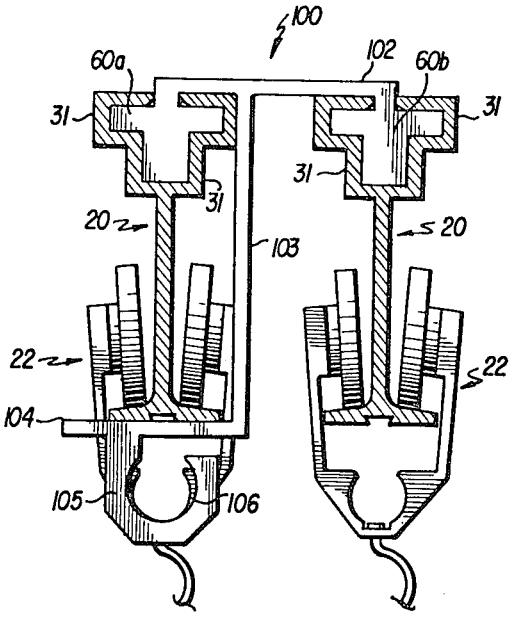
FIG. 14 is an elevational view of the spacer shown in FIG. 13 supporting a pair of curtain rods with a carrier shown on each.

In FIGS. 13 and 14, a lapping spacer designated generally by reference numeral 100 is illustrated. Spacer 100 performs the different functions of being a lapping spacer for overlapping rods at the midway curtain overlap, a carrier for such rods and a rope holder or support for the rope utilized for moving the curtains and located at the midlap of overlapping curtains or drapery. In this connection it will be understood that normally two curtain rods 20 are provided which are separated to permit the two curtain sections to overlap in the central location of the area served by the curtains. The spacing function of the spacer 100 is served by the upper part which comprises a flat plate portion 102 with depending cruciform-shaped support parts 60*a* and 60*b* at the edges thereof, such parts 60*a* and 60*b* being so configured to be slideably received in the space comprising slot 26, grooves 27 and recess 40 of curtain rod 20 are in this sense identical to part 60. Extending downwardly from plate portion 102 between support parts 60*a* and 60*b* is a bumper part 103 which includes a horizontal leg 104. A rope guide 105 extends downwardly from leg 104 to hook around and partly surround a cylindrically-shaped horizontally disposed guide space 106 which receives the rope in a slideable fashion for moving the curtains and provides support for same. Leg 104, together with guide 105 functions to support rope for moving the curtains approximately at the upper central part thereof. Thus, the rope is supported at about the middle of the complete track to minimize its sagging.

Figure 15:
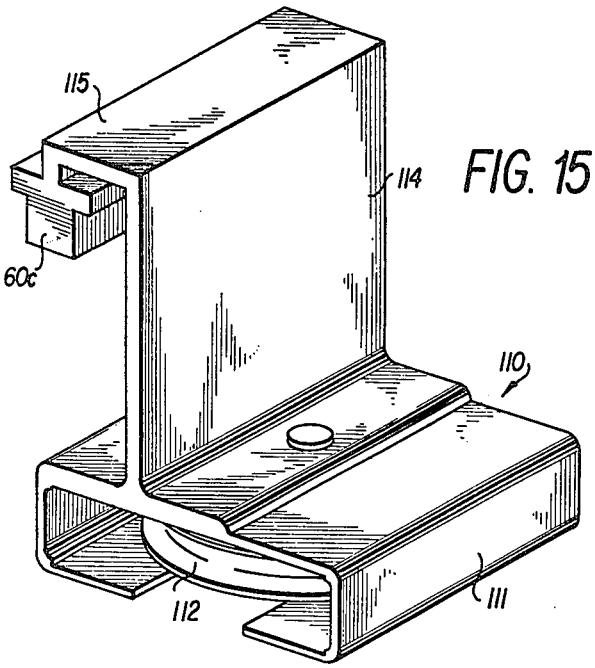
FIG. 15 is a perspective view of a combination deadend pulley and rod supports.

In FIG. 15, a single-end pulley also known as a deadend pulley member 110 is shown which comprises a housing 111 which carries the pulley 112 and has extending upwardly therefrom a vertical plate 114 which integrally connects to a horizontal plate 115. Depending from the plate 115 is a cruciform-shaped member 60*c* which, identical to parts 60, 60*a* and 60*b*, is configured to be received by the space defined by slot 26, grooves 27 and recess 40 of curtain rod 20. By then affixing part 60*c* relative to rod 20 by a bolt 38 or set screw 108 (See FIG. 13), pulley 112 is automatically aligned in its desired location relative to rods 20 and carriers 22 for overlapping curtains carried by carriers 22. The same is true with reference to the double-end pulley known as a live-end pulley member 116 shown in FIG. 17. It will be understood that the live-end pulley member 116 includes a bracket 117, a cover plate 120 and, identical to the deadend pulley member 110, a vertical plate 114, horizontal plate 115 and support part 60*c*. An axle 121 rotatably carries a pair of pulleys 122 which are secured relative to vertical plate 114 by a nut (not shown). A pair of rotatable keepers 125 are also bolted to the bracket 117 which serve the purpose of maintaining rope 126 within the pulleys 122.

Figure 15A:
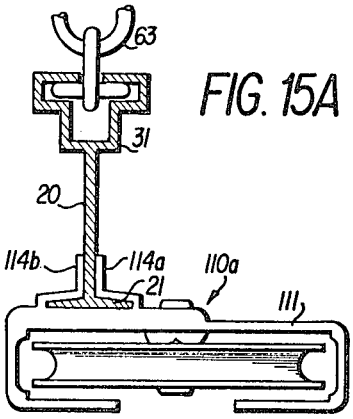
FIG. 15A is an elevational view of a rod supported deadend pulley.

FIG. 15A shows in elevational view an alternative embodiment of a deadend pulley member which is designated 110*a*. Here it will be noted that housing 111 is provided with a pair of upstanding profiled plates 114*a* and 114*b* which receive flange 21 of rod 20 which in turn is supported by link chain 63 received in the space defined by arms 31 as previously explained.

Figure 16:
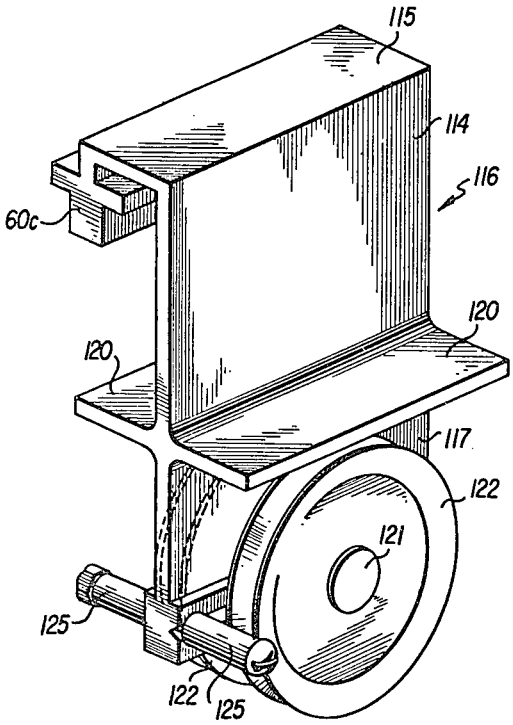
FIG. 16 is a perspective view of a combination liveend pulley and rod support.
Figure 16A:
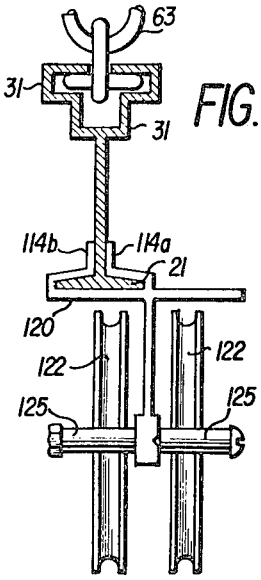
FIG. 16A is an elevational view of a rod supported live-end pulley.

In the embodiment of FIG. 16A of a modified live-end pulley, similar profiled plates 114*a* and 114*b* are provided so as to be connected to and integral with cover part 120 which, as shown in FIG. 16A, are configured to receive flange 21 of rod 20 which, in turn, is supported by link chain 63 received in a space between arms 31 as previously explained and shown in more detail in FIG. 2. Again, either pulley member 110*a* or 116*a* as shown in FIGS. 15A and 16A may be affixed to a rod 20 by means of a set screw, bolt or other suitable means. Also, again, each pulley device is automatically located relative to rod 20 and carrier 22 through the arrangement disclosed.

Figure 17:
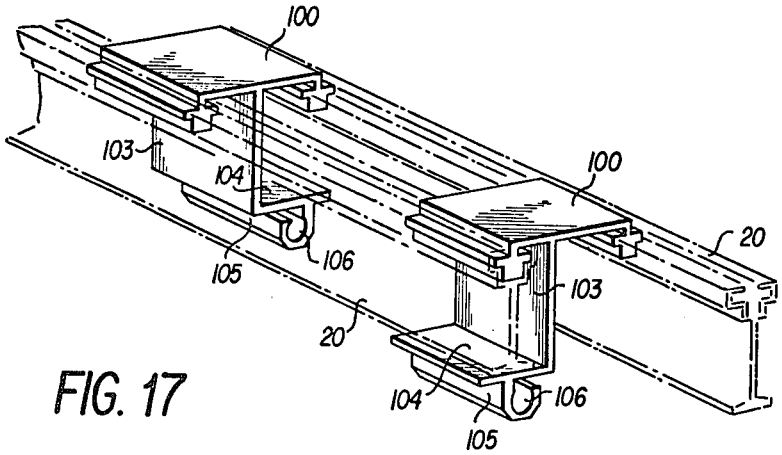
FIG. 17 is a perspective view illustrating the utilization of a pair of lapping spacers as shown in FIGS. 13 and 14 within the curtain suspension system.

FIGS. 17 and 18 disclose the assembly whereby the cooperation of various components may be more readily understood. In FIG. 17, the disposition of a pair of spacers 100 relative to overlapping rods 20 (shown in dot-dash lines) at the midway curtain overlap is shown.

In FIG. 18, an assembly is shown including the endless rope 126 and a floor pulley member 127 which includes a pulley 130 held in a housing 131 comprised of a pair of spaced plates 132 and 134 held in alignment by spacing bolts 135, plates 132 and 134 being affixed to a bottom plate 136 which is secured to the deck. Pulley 130 is supported by an axle 137 which is held in its desired vertical disposition by a wing nut 140 within vertically disposed slots 141 whereby the height of the pulley 180 is vertically adjustable relative to the housing 131.

Referring to FIGS. 17 and 18, it will be noted that a pair of overlapping rods 20 are in part supported and held the desired distance apart by means of spacers 100 which also function to prevent carriers 22 from moving off of the respective rods 20. A rope 126 for opening and closing the curtain carried by carriers 22 is received in an endless manner about the pulley 112 into space 54 of each carrier 22 wherein it is frictionally received and secured and causes the carriers 22 therefore to move with it. Rope 126 extends through guide space 106 in rope guide 105 through which it easily slides, to the live-end pulley 122 and finally to and around the floor pulley 130. Thus by causing rope 126 to be moved to one direction or the other, carriers 22 together with curtains suspended therefrom are caused to move so that the curtain is either opened or closed and, upon closing, overlaps a distance as defined longitudinally between the spacers 100.

The components of the assembly such as rods 20 and 20*a*, rod supports 30, angle clip 68, I-beam clamps 69, spacers 100, pulley members 110, 110*a*, 116 and 116*a*, are, insofar as practicable, extruded aluminum. The drawings are approximately proportional to the actual components used. As a measure of comparison, rod 20 is about 6.6 cm in height and 3.5 cm in width across arm 31 and 3.0 cm across flange 21. Size is important to cost of manufacture as well as to strength and weight of the components.

Referring to FIGS. 19–22, hanger rods 150 are installed prior to the ceiling installation whereby they depend from positive connections to the structural members above the ceiling which may be an inexpensive tilt-out ceiling system over the stage area. Such ceilings are frequently used because they provide increased safety in the event of fire. Hangers 150 are threaded throughout their length and receive a first support member 151 through an opening 152 in the horizontal flange part of member 151. Depending and integral with flange part 154 opposite opening 152, is a cruciform-shaped portion 155 which is received in the matching cruciform-shaped groove 162 of upper portion 156 of strut 157.

It is to be observed that strut 157 has an I-beam central portion 160 which is integral with and connects with the upper portion 156 and an identical but oppositely extending lower portion 161. Cruciform-shaped groove 162 of the upper portion 156 is defined by a pair of arms 164 and 165 which extend from the upper flanges of the I-beam portion 160. In a similar manner, a pair of lower arms 166 and 167 define a cruciform-shaped groove 170 at the lower aspect of strut 157. A second support member 151*a* has a cruciform-shaped portion 155*a* which is received in the slot 170. Opening 152*a* in support member 151*a* receives a bolt 171. The upper support member 151 is retained firmly in position relative to the hanger 150 by a pair of nuts 172 and 174 which are tightened firmly against flange part 154. Bolt 171 and nut 175 are used to connect to a third support member 151*b* which is received within slot 26 of rod 20. Thus, it will be appreciated that rod 20 is supported by hanger 150 which connects to the upper first support member 151, through the strut 157 to the lower second support member 151*a* and finally through the further third support member 151*b*. The support members 151, 151*a* and 151*b* have the same cross-section but they may be of differing lengths, as desired.

Figure 21:
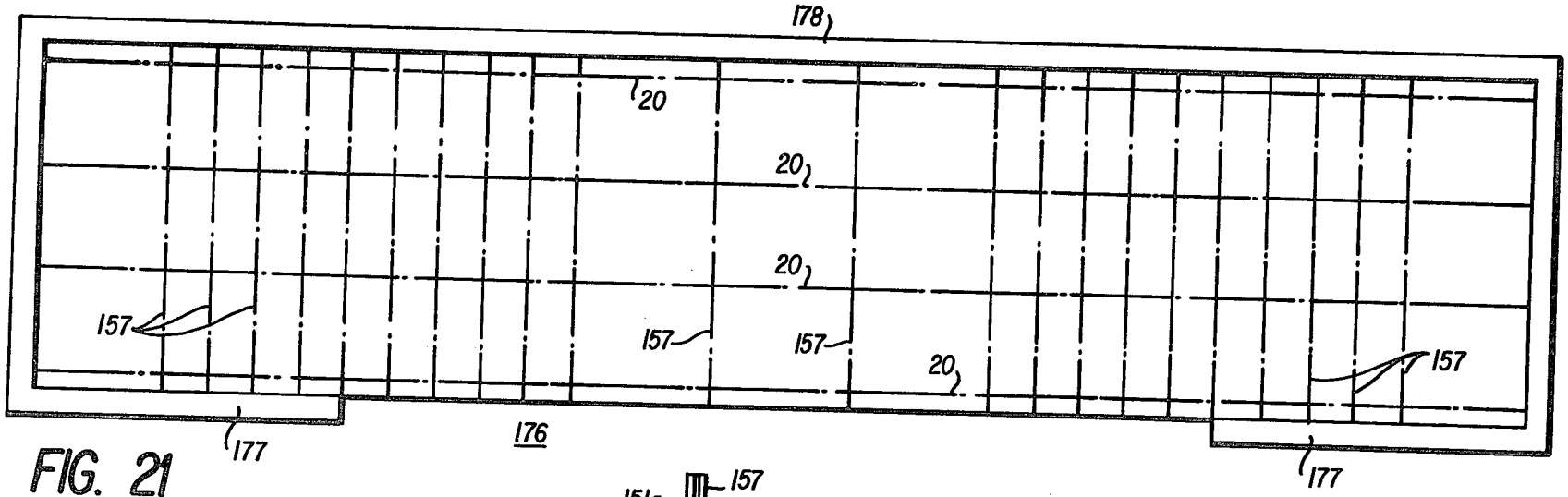
FIG. 21 is a diagrammatic illustration of an installed stage equipment support strut system in accordance with the invention.
Figure 22:
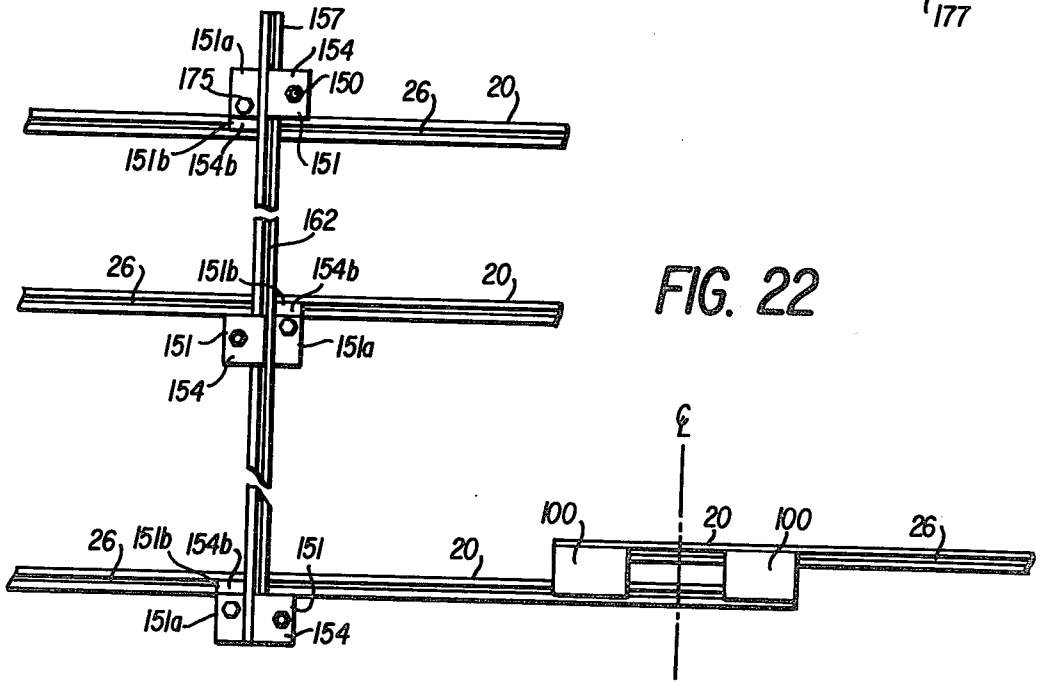
FIG. 22 is a broken detail view of the system of FIG. 21 showing in plan connections between a strut and curtain rods.

As seen in FIG. 21, the proscenium opening 176 lies between the stage walls 177 and the strut-channel system shown in FIG. 21 below the ceiling comprises parallel rows of struts 157, perpendicular to the plane of the proscenium opening 176, extending for the full depth of the stage from the proscenium opening plane to the rear stage wall 178. It will be noted that the central four struts 157 are separated apart about three times the distance between struts 157 on both sides of such center portion. In practice, these distances are six feet and two feet, respectively. Four rods 20 are shown which extend parallel to the proscenium opening plane. However, it is to be understood that these rods 20 each comprise, in fact, two rods which are joined at the center by spacers 100 in a manner as shown in FIGS. 17 and 22. Otherwise, the curtains would be drawn together without any overlap.

Support members 151 may be, and preferably are, spaced to extend alternately relative to the strut 157 as shown in Figure and the same is true insofar as the further support members 151*a* and 151*b* are concerned. By this means, the strength of the system is, to a certain degree, increased. Rods 20 are installed whereby their flanges 21 are a height greater than the vertical dimensions of the proscenium opening—say about one yard.

An advantage of struts 157 aside from their strength is that, being extruded aluminum, they do not require painting or cladding as a protective coating. Nevertheless, their strength is sufficient whereby they may be used in lieu of known steel channel bars wherein galvanized zinc and other types of finishes are required.

Figure 20:
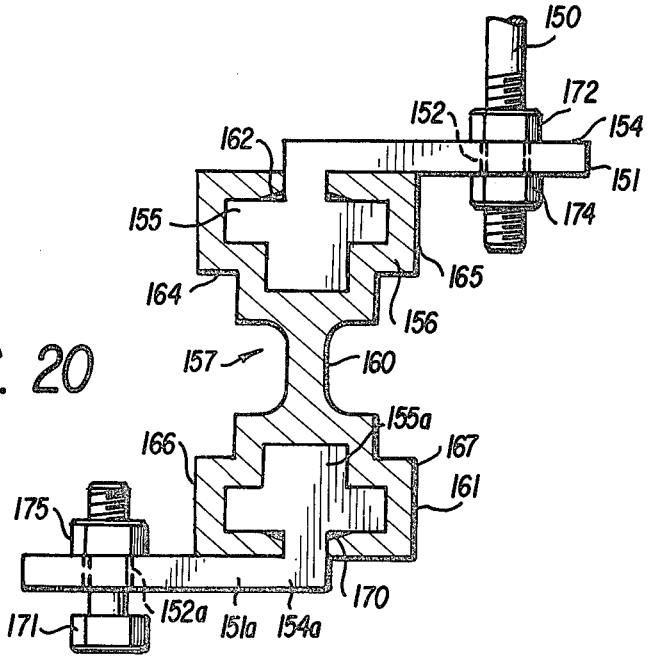
FIG. 20 is a cross-sectional view taken on lines 20—20 in FIG. 19.

In practice, practical dimensions for struts 157 are: height—6.4 cm, width—3.8 cm, width of grooves—2.7 cm, width of access slots—0.7 cm, vertical dimensions of grooves (including the access slots)—2 cm. The relative dimensions of the components as shown in cross-section in FIG. 20 are approximately correct. Using the components disclosed as arranged in FIG. 21, a load of ten pounds per square foot can be supported over the entire stage area and a concentrated load of 250 pounds can be supported at any place along struts 157.

Although the preferred embodiments of the invention are described above, it is to be understood that the invention includes other adaptations and modifications within the scope of the appended claims which should be construed to cover corresponding structure described in this specification and equivalents thereof.

Having thus described my invention, what I claim as new and desire to secure by Letters Patent of the United States is:

1. A traverse rod support strut in combination with a support member, said strut comprising an upper support portion which defines a cruciform-shaped groove and a lower portion which defines a like cruciform-shaped groove, said strut being symmetrically disposed on either side of a vertically disposed plane parallel to its length and of a horizontally disposed plane parallel to its length and having a substantially uniform cross-section within a further vertical plane perpendicular to the first-mentioned plane, said support member comprising a cruciform-shaped part adapted to mate with and be slidably received in either said groove and a connection part integral with and extending from said cruciform-shaped part parallel to said horizontally disposed plane and closely adjacent the outer surface of said support portion in which it is received, a ceiling above said strut, hanger means depending from said ceiling received by said support member providing support for said strut.

2. A strut in accordance with claim 1 wherein there are two support members of identical cross-section, one said support member received in said groove in said upper portion and the other said support member received in said groove in said lower portion.

3. A strut in accordance with claim 1, wherein said support member is connected with said hanger means depending from said ceiling by being received in an opening in said support member, said hanger means being threaded on its lower end and having a nut thereon securing it to said support member.

4. A strut in accordance with claim 2 wherein a third support member is provided which has a third cruciform-shaped portion, said third support member being firmly connected to said second mentioned support member, the cruciform-shaped portion of said third support member being received in a matching cruciform-shaped groove of a traverse rod for supporting curtains and the like.

5. A strut in accordance with claim 4, wherein said rod extends substantially perpendicular to said strut.

6. A strut in accordance with claim 1 wherein there are a plurality of said support members received in said upper groove.

7. A strut in accordance with claim 6 wherein said support members extend alternately outwardly relative from said upper groove.

8. A strut in accordance with claim 1 wherein the strut and said support members are composed of extruded aluminum.

9. A strut in accordance with claim 8 wherein the strut is combined with a plurality of like struts which are supported to extend normally to a proscenium opening plane of a stage and which support a plurality of traverse curtain rods which extend parallel to said plane.

10. A plurality of struts in accordance with claim 9 wherein link chains are received in said upper grooves of said rods to provide support at least in part for said plurality of struts.

* * * * *